US011431095B2

(12) United States Patent
Huh et al.

(10) Patent No.: US 11,431,095 B2
(45) Date of Patent: Aug. 30, 2022

(54) ANTENNA DEVICE AND DISPLAY DEVICE COMPRISING THE SAME

(71) Applicants: DONGWOO FINE-CHEM CO., LTD., Jeollabuk-do (KR); KREEMO INC., Seoul (KR)

(72) Inventors: Yoon Ho Huh, Seoul (KR); Han Sub Ryu, Gyeongsangbuk-do (KR); Byung Jin Choi, Gyeonggi-do (KR); Won Bin Hong, Seoul (KR)

(73) Assignees: DONGWOO FINE-CHEM CO., LTD., Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 17/012,814

(22) Filed: Sep. 4, 2020

(65) Prior Publication Data

US 2020/0403315 A1 Dec. 24, 2020

Related U.S. Application Data

(63) Continuation of application No. PCT/KR2019/002521, filed on Mar. 5, 2019.

(30) Foreign Application Priority Data

Mar. 6, 2018 (KR) ..... 10-2018-0026381

(51) Int. Cl.
*H01Q 1/24* (2006.01)
*H01Q 9/04* (2006.01)
(Continued)

(52) U.S. Cl.
CPC ..... *H01Q 9/0407* (2013.01); *H01Q 1/243* (2013.01); *H01Q 1/48* (2013.01); *H01Q 21/065* (2013.01)

(58) Field of Classification Search
CPC . H01Q 1/24–48; H01Q 9/0407; H01Q 21/065
See application file for complete search history.

(56) References Cited

U.S. PATENT DOCUMENTS

2014/0111684 A1* 4/2014 Corbin ..... H04N 5/2257 343/702
2016/0190678 A1 6/2016 Hong et al.
2020/0312798 A1* 10/2020 Kawahata ..... H01L 23/66

FOREIGN PATENT DOCUMENTS

CN 103026551 A 4/2013
CN 105742797 A 7/2016
(Continued)

OTHER PUBLICATIONS

Notice of Allowance dated Nov. 16, 2021 from Japan Intellectual Property Office in a counterpart Japanese Patent Application No. 2020-568654 (all the cited references are listed in this IDS.) (English translation is also submitted herewith.).
(Continued)

*Primary Examiner* — Hasan Islam
(74) *Attorney, Agent, or Firm* — The PL Law Group, PLLC

(57) ABSTRACT

An antenna device according to an embodiment of the present invention includes a dielectric layer, a first electrode layer disposed on a top surface of the dielectric layer, the first electrode layer including a radiation pattern, a second electrode layer disposed on a bottom surface of the dielectric layer, and a flexible circuit board connecting the first electrode layer and the second electrode layer with each other along a lateral portion of the dielectric layer. Efficiency of grounding and noise removing may be improved by the flexible circuit board.

13 Claims, 6 Drawing Sheets

(51) Int. Cl.
*H01Q 1/48* (2006.01)
*H01Q 21/06* (2006.01)

(56) References Cited

FOREIGN PATENT DOCUMENTS

| | | | |
|---|---|---|---|
| JP | 2000-138512 | A | 5/2000 |
| JP | 2001-154178 | A | 6/2001 |
| JP | 2003-332830 | A | 11/2003 |
| JP | 2006-286760 | A | 10/2006 |
| JP | 2010-103388 | A | 5/2010 |
| JP | 2014-086655 | A | 5/2014 |
| JP | 2017-135465 | A | 8/2017 |
| JP | 2017-175540 | A | 9/2017 |
| JP | 2017-175541 | A | 9/2017 |
| KR | 10-2003-0095557 | A | 12/2003 |
| KR | 10-2007-0028125 | A | 3/2007 |
| WO | WO 2006/106759 | A1 | 10/2006 |
| WO | WO 2012/036139 | A1 | 3/2012 |

OTHER PUBLICATIONS

International Search Report for PCT/KR2019/002521 dated Jun. 12, 2019.

* cited by examiner

ANTENNA DEVICE AND DISPLAY DEVICE COMPRISING THE SAME

CROSS REFERENCE TO RELATED APPLICATIONS AND CLAIM OF PRIORITY

The present application is a continuation application to International Application No. PCT/KR2019/002521 with an International Filing Date of Mar. 5, 2019, which claims the benefit of Korean Patent Application No. 10-2018-0026381 filed on Mar. 6, 2018 at the Korean Intellectual Property Office, the disclosures of which are incorporated by reference herein in their entirety.

BACKGROUND

1. Field

The present invention relates to an antenna device and a display device including the same. More particularly, the present invention relates to an antenna device including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating a high or ultra-high frequency communication is needed in the display device.

Further, as the display device equipped with the antenna becomes thinner and light-weighted, a space for the antenna may be also decreased. Accordingly, the antennas may be adjacent to various conductive structures, circuit structures and sensing structures of the display device within a limited space, and thus an antenna driving may be interfered or disturbed by external noises.

For example, an additional interconnecting structure is employed to connect electrodes and pads included in the antenna. When forming the interconnecting structure, a thickness of the antenna may increase, and mutual interferences and noises with other pixel structures or sensing structures in the display device may be caused.

SUMMARY

According to an aspect of the present invention, there is provided an antenna device having improved signaling efficiency.

According to an aspect of the present invention, there is provided a display device including an antenna device with improved signaling efficiency.

(1) An antenna device, including: a dielectric layer; a first electrode layer disposed on a top surface of the dielectric layer, the first electrode layer including a radiation pattern; a second electrode layer disposed on a bottom surface of the dielectric layer; and a flexible circuit board connecting the first electrode layer and the second electrode layer with each other along a lateral portion of the dielectric layer.

(2) The antenna device according to the above (1), wherein the first electrode layer includes a ground pad, and the flexible circuit board and the ground pad are connected with each other.

(3) The antenna device according to the above (2), wherein the second electrode layer includes a ground layer.

(4) The antenna device according to the above (2), wherein the flexible circuit board includes: a core layer; an upper wiring disposed on a top surface of the core layer, the upper wiring including a signal wiring and an upper ground wiring; a lower wiring disposed on a bottom surface of the core layer; and a ground contact penetrating through the core layer to electrically connect the upper ground wiring and the lower wiring.

(5) The antenna device according to the above (4), wherein the ground pad of the first electrode layer is electrically connected to the second electrode layer through the upper ground wiring, the ground contact and the lower wiring of the flexible circuit board.

(6) The antenna device according to the above (5), wherein the lower wiring of the flexible circuit board serves as a lower ground wiring.

(7) The antenna device according to the above (4), wherein the first electrode layer further includes a signal pad, and the signal pad is electrically connected to the signal wiring of the upper wiring in the flexible circuit board.

(8) The antenna device according to the above (7), wherein the signal pad is interposed between a pair of the ground pads.

(9) The antenna device according to the above (1), wherein the flexible circuit board includes a first flexible circuit board electrically connected to the first electrode layer, and a second flexible circuit board electrically connected to the second electrode layer.

(10) The antenna device according to the above (9), further including a conductive connection structure electrically connecting the first flexible circuit board and the second flexible circuit board with each other.

(11) The antenna device according to the above (1), further including a first conductive intermediate layer connecting the flexible circuit board and the first electrode layer with each other, and a second conductive intermediate layer connecting the flexible circuit board and the second electrode layer with each other.

(12) The antenna device according to the above (1), wherein first electrode layer includes a mesh structure.

(13) The antenna device according to the above (12), further including a dummy mesh layer arranged around the radiation pattern.

(14) A display device including the antenna device according to embodiments as described above.

(15) The display device according to the above (14), wherein the display device includes a display area and a peripheral area, at least a portion of the radiation pattern of the first electrode layer is disposed in the display area, and the flexible circuit board connects the first electrode layer and the second electrode layer to each other through the peripheral area.

According to exemplary embodiments of the present invention, an upper electrode and a lower electrode of an antenna device may be connected to each other by a flexible circuit board. For example, a ground pad included in the upper electrode and the lower electrode serving as a ground layer may be connected to each other so that a grounding reliability may be improved without disturbance by an external noise. Further, a feeding may be efficiently performed to each of the upper electrode and the lower electrode through the flexible circuit board.

The flexible circuit board may connect the upper electrode and the lower electrode along a lateral portion of the antenna device without penetrating the antenna device. Thus, a mutual interference with an active or passive circuit structure of the display device may be suppressed without increasing a thickness of the antenna device.

DETAILED DESCRIPTION OF THE EMBODIMENTS

According to exemplary embodiments of the present invention, there is provided an antenna device including a first electrode layer and a second electrode layer with a dielectric layer interposed therebetween, and including a flexible circuit board (e.g., Flexible Printed Circuit Board (FPCB)) that connects the first electrode layer and the second electrode layer with each other.

The antenna device may be, e.g., a microstrip patch antenna fabricated in the form of a transparent film. For example, the antenna device may be applied to a device for high frequency band or ultra-high frequency band (e.g., 3G, 4G, 5G or more) mobile communications.

According to exemplary embodiments of the present invention, there is also provided a display device including the antenna device. However, an application of the antenna device is not limited to the display device, and the antenna device may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
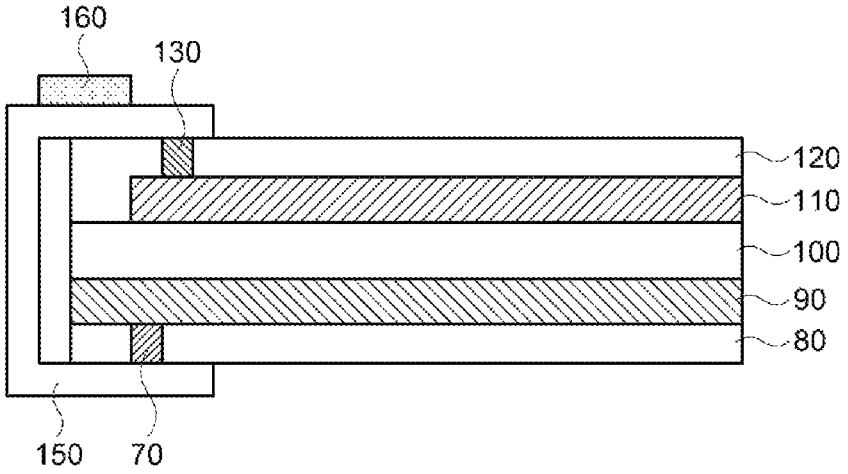
FIG. 1 is a schematic cross-sectional view illustrating an antenna device in accordance with exemplary embodiments.

FIG. 1 is a schematic cross-sectional view illustrating an antenna device in accordance with exemplary embodiments.

Referring to FIG. 1, the antenna device may include a dielectric layer 100, a first electrode layer 110, a second electrode layer 90 and a flexible circuit board 150 electrically connecting the first and second electrode layers 110 and 90 with each other.

The dielectric layer 100 may include, e.g., a transparent resin material. For example, the dielectric layer 100 may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth)acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyethersulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination of two or more thereof.

In some embodiments, an adhesive film such as an optically clear adhesive (OCA), an optically clear resin (OCR), or the like may be included in the dielectric layer 100.

In some embodiments, the dielectric layer 100 may include an inorganic insulating material such as glass, silicon oxide, silicon nitride, silicon oxynitride, etc.

In an embodiment, the dielectric layer 100 may serve as a substantially single layer. In an embodiment, the dielectric layer 100 may have a multi-layered structure including at least two layers.

A capacitance or an inductance may be formed between the first electrode layer 110 and the second electrode layer 90 by the dielectric layer 100 so that a frequency band at which the antenna device may be driven or operated may be adjusted. In some embodiments, a dielectric constant of the dielectric layer 100 may be adjusted in a range from about 1.5 to about 12. When the dielectric constant exceeds about 12, a driving frequency may be excessively reduced so that an antenna driving in a desired high frequency band may not be realized.

The first electrode layer 110 may be disposed on a top surface of the dielectric layer 100. The first electrode layer 110 may include a radiation pattern of the antenna device. In exemplary embodiments, the first electrode layer 110 may further include a pad electrode and a transmission line, and the pad electrode and the radiation pattern may be electrically connected to each other by the transmission line. The pad electrode may include a signal pad and a ground pad.

Elements and structures of the first electrode layer 110 will be described in more detail with reference to FIGS. 5 to 7.

The second electrode layer 90 may be disposed on a bottom surface of the dielectric layer 100. In exemplary embodiments, the second electrode layer 90 may serve as a ground layer of the antenna device.

In an embodiment, a conductive member of the display device including the antenna device may serve as the second electrode layer 90 (e.g., the ground layer). The conductive member may include, e.g., a gate electrode of a thin film transistor (TFT) included in a display panel, various wirings such as a scan line or a data line or various electrodes such as a pixel electrode and a common electrode.

In an embodiment, e.g., various structures including a conductive material disposed under the display panel may serve as the second electrode layer 90. For example, a metal plate (e.g., a stainless steel plate such as a SUS plate), a pressure sensor, a fingerprint sensor, an electromagnetic wave shielding layer, a heat dissipation sheet, a digitizer, etc., may serve as the second electrode layer 90.

For example, the first electrode layer 110 and the second electrode layer 90 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy thereof. These may be used alone or in combination thereof. For example, silver (Ag) or a silver alloy (e.g., a silver-palladium-copper (APC) alloy) may be used for implementing a low resistance.

In an embodiment, the first electrode layer 110 and the second electrode layer 90 may include copper (Cu) or a copper alloy in consideration of low resistance and pattern formation with a fine line width. For example, the first electrode layer 110 and the second electrode layer 90 may include a copper-calcium (Cu—Ca) alloy.

In some embodiments, the first and second electrode layers 110 and 90 may include a transparent metal oxide such as indium tin oxide (ITO), indium zinc oxide (IZO), indium zinc tin oxide (ITZO), zinc oxide (ZnOx), etc.

For example, the first and second electrode layers 110 and 90 may have a multi-layered structure including a metal or alloy layer and a transparent metal oxide layer.

In exemplary embodiments, the first electrode layer 110 and the second electrode layer 90 may be electrically connected to each other by the flexible circuit board 150. As illustrated in FIG. 1, one end portion of the flexible circuit board 150 may be electrically connected to the first electrode layer 110 on the top surface of the dielectric layer 100, and the other end portion of the flexible circuit board 150 may be electrically connected to the second electrode layer 90 under the bottom surface of the dielectric layer 100.

In some embodiments, the flexible circuit board 150 may extend along a lateral portion of the antenna device or the dielectric layer 100 to connect the first electrode layer 110 and the second electrode layer disposed 90 formed on the dielectric layer 100 and under the dielectric layer 100, respectively.

In some embodiments, the flexible circuit board 150 may be connected to the first electrode layer 110 through a first conductive intermediate layer 130 and may be connected to the second electrode layer 90 through a second conductive intermediate layer 70.

For example, an upper insulating layer 120 and a lower insulating layer 80 covering the first electrode layer 110 and the second electrode layer 90, respectively, may be formed, and openings that may partially expose the first electrode layer 110 and the second electrode layer 90 may be formed. The openings may be filled with a conductive material to form the first conductive intermediate layer 130 and the second conductive intermediate layer 70.

The upper insulating layer 120 and the lower insulating layer 80 may include, e.g., an organic material such as an acrylic resin, polyimide, an epoxy resin, polyester, a cyclo-based polymer (e.g., cycloolefin polymer, etc.) or an inorganic insulating material silicon oxide, silicon nitride, etc.

The first conductive intermediate layer 130 and the second conductive intermediate layer 70 may include, e.g., an anisotropic conductive film (ACF), a conductive paste, etc., or may be formed by depositing a metal in the opening.

In exemplary embodiments, the one end portion of the flexible circuit board 150 may be electrically connected to the ground pad included in the first electrode layer 110, and thus the ground pad may be electrically connected to the second electrode layer 90. As described above, the second electrode layer 90 may serve as the ground layer, and an upper ground and a lower ground of the antenna device may be connected to each other by the flexible circuit board 150.

A driving integrated circuit (IC) chip 160 may be disposed on the flexible circuit board 150. For example, the driving IC chip 160 may be electrically connected to each of the signal pad and the ground pad included in the first electrode layer 110 through circuits or wirings included in the flexible circuit board 150 to perform a feeding.

The driving IC chip 160 may be mounted directly on the flexible circuit board 150. Alternatively, the driving IC chip 160 unit may be mounted on the flexible circuit board 150 via an intermediate circuit board such as a rigid circuit board.

For example, as illustrated in FIG. 1, the driving IC chip 160 may be disposed on the one end portion of the flexible circuit board 150 connected to the first electrode layer 110.

In a comparative example, if the ground pad included in the first electrode layer 110 is not connected to the lower ground (e.g., the second electrode layer 90) and exists as an independent or floating pattern on the dielectric layer 100, an antenna driving may be deteriorated by noises from various electronic devices and circuit devices of the display device into which the antenna device is inserted. Further, a noise removal through the ground pattern or the ground layer may not be effectively implemented.

However, according to the above-described exemplary embodiments, the ground pad and the lower ground may be connected to each other through the flexible circuit board 150, so that the efficiency and reliability of noise removal and grounding may be improved.

In a comparative example, it may be considered to form a contact or via structure penetrating the dielectric layer 100 in order to connect the ground pad and the lower ground to each other. However, the thickness of the dielectric layer 100 may be increased for the formation of the contact or via structure, and thus radiation properties through a desired dielectric constant may not be achieved. Further, the formation of the contact or the via structure may be substantially limited according to an arrangement of various electronic devices and circuit devices of the display device.

However, according to the above-described exemplary embodiments, the flexible circuit board 150 disposed on the lateral portion of the antenna device or the dielectric layer 100 may be utilized without penetrating the antenna device or the dielectric layer 100 so that the thickness of the antenna device may not be increased, and operational and spatial restrictions by the structures of the display device may be substantially avoided.

Figure 2:
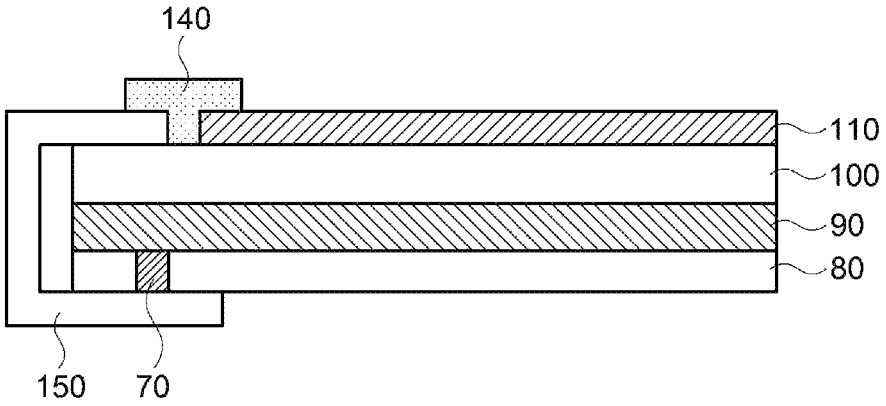
FIG. 2 is a schematic cross-sectional view illustrating an antenna device in accordance with some exemplary embodiments.

FIG. 2 is a schematic cross-sectional view illustrating an antenna device in accordance with some exemplary embodiments.

Referring to FIG. 2, one end portion of the flexible circuit board 150 may be bent toward the top surface of the dielectric layer 100. In this case, the one end portion of the flexible circuit board 150 and the first electrode layer 110 may be substantially positioned at the same layer or at the same level. For example, the one end portion of the flexible circuit board 150 and the first electrode layer 110 may be disposed commonly on the top surface of the dielectric layer 100.

As illustrated in FIG. 2, the one end portion of the flexible circuit board 150 and the first electrode layer 110 may be spaced apart from each other on the top surface of the dielectric layer 100. In this case, the one end portion of the flexible circuit board 150 and the first electrode layer 110 may be electrically connected to each other by a first conductive intermediate layer 140.

For example, the first conductive intermediate layer 140 may be formed to partially cover the one end portion of the flexible circuit board 150 and a top surface of the first electrode layer 110 to connect a wiring in the flexible circuit board 150 and the ground pad of the first electrode layer 110.

Figure 3:
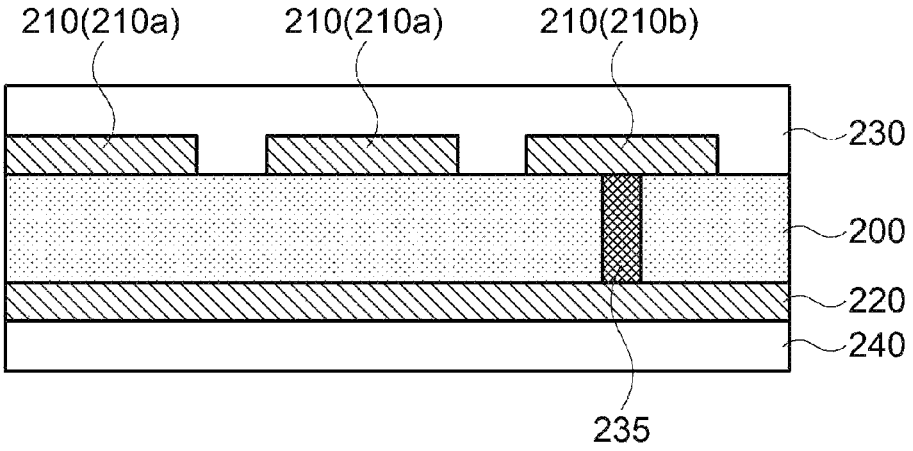
FIG. 3 is a schematic cross-sectional view illustrating a construction of a flexible circuit board in accordance with exemplary embodiments.

FIG. 3 is a schematic cross-sectional view illustrating a construction of a flexible circuit board according to exemplary embodiments.

Referring to FIG. 3, the flexible circuit board may have a double-sided circuit board structure. In exemplary embodiments, the flexible circuit board may include a core layer 200, and an upper wiring 210 and a lower wiring 220 formed on top and bottom surfaces of the core layer 200, respectively. An upper coverlay film 230 and a lower coverlay film 240 for a wiring protection may be formed on the top and bottom surfaces of the core layer 200, respectively.

The core layer 200 may include, e.g., a resin material having flexibility such as polyimide, an epoxy resin, polyester, a cycloolefin polymer (COP), a liquid crystal polymer (LCP), etc.

In exemplary embodiments, the upper wiring 210 may include a signal wiring 210*a* and an upper ground wiring 210*b*. The lower wiring 220 may serve as, e.g., a lower ground wiring. The upper ground wiring 210*b* of the upper wiring 210 may be electrically connected to the lower wiring 220 through a ground contact 235 penetrating through the core layer 200.

In some embodiments, as illustrated in FIG. 1, the ground pad of the first electrode layer 110 and the second electrode layer 90 of the antenna device may be connected to each other via the lower wiring 220 of the flexible circuit board 150. In this case, the ground pad of the first electrode layer 110 and the second electrode layer 90 may be connected to the upper ground wiring 210*b* via the ground contact 235 included in the flexible circuit board 150.

For example, a ground signal or a feeding may be performed from the driving IC chip 160 via the upper ground wiring 210*b*.

In some embodiments, the first electrode layer 110 of the antenna device may be connected to the upper wiring 210 of the flexible circuit board 150, and the second electrode layer 90 of the antenna device may be connected to the lower wiring 220.

For example, the signal pad included in the first electrode layer 110 may be connected to the signal wiring 210*a* of the flexible circuit board 150, and the ground pad included in the first electrode layer 110 may be connected to the upper ground wiring 210*b* of the flexible circuit board 150.

Accordingly, the ground pad of the first electrode layer 110 and the second electrode layer 90 may be electrically connected to each other through the ground contact 235 included in the flexible circuit board 150.

Figure 4:
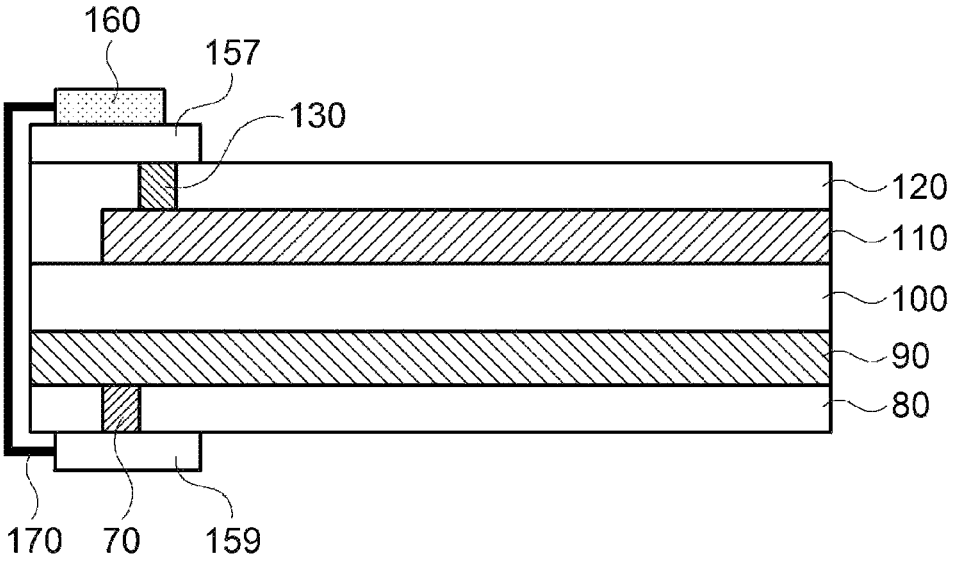
FIG. 4 is a schematic cross-sectional view illustrating an antenna device in accordance with some exemplary embodiments.

FIG. 4 is a schematic cross-sectional view illustrating an antenna device in accordance with some exemplary embodiments.

Referring to FIG. 4, a first flexible circuit board 157 and a second flexible circuit board 159 electrically connected to the first electrode layer 110 and the second electrode layer 90, respectively, may be individually provided.

In exemplary embodiments, the first flexible circuit board 157 may be disposed on the top surface of the dielectric layer 100 to be electrically connected to the first electrode layer 110. For example, the first flexible circuit board 157 may be disposed on the upper insulating layer 120 and may be electrically connected to the first electrode layer 110 via the first conductive intermediate layer 130.

The second flexible circuit board 159 may be disposed under the bottom surface of the dielectric layer 100 to be electrically connected to the second electrode layer 90.

For example, the second flexible circuit board 159 may be disposed on the lower insulating layer 80 and may be electrically connected to the second electrode layer 90 via the second conductive intermediate layer 70.

The first flexible circuit board 157 and the second flexible circuit board 159 may be connected to each other via a conductive connection structure 170. The conductive connection structure 170 may include, e.g., a metal wire or an additional flexible circuit board.

For example, both end portions of the conductive connection structure 170 may each be connected to the first flexible circuit board 157 and the second flexible circuit board 159 by a bonding process such as a fusion bonding, a welding or a soldering.

The conductive connection structure 170 may be disposed on the lateral portion of the antenna device or the dielectric layer 100. In an embodiment, the conductive connection structure 170 may be omitted, and end portions of the first flexible circuit board 157 and the second flexible circuit board 159 may be merged by the bonding process.

The driving IC chip 160 may be disposed on the first flexible circuit board 157.

Figure 5:
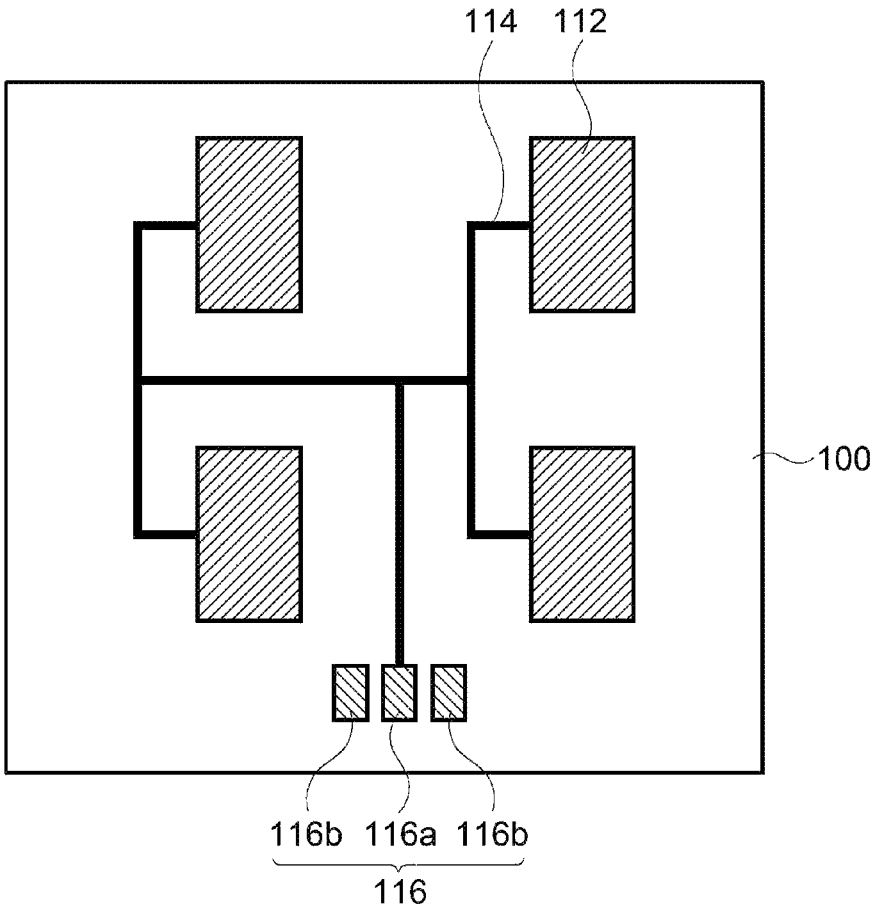
FIG. 5 is a top planar view illustrating a first electrode layer of an antenna device in accordance with some exemplary embodiments.

FIG. 5 is a top planar view illustrating a first electrode layer of an antenna device in accordance with some exemplary embodiments.

Referring to FIG. 5, the first electrode layer 110 (see FIGS. 1, 2 and 4) may include a radiation pattern 112, a transmission line 114 and pad electrodes 116 disposed on the dielectric layer 100.

In some embodiments, the pad electrode may include a signal pad 116*a* and a ground pad 116*b*. For example, a signal pad 116*a* may be disposed between a pair of the ground pads 116*b*.

As illustrated in FIG. 5, a plurality of the radiation patterns 112 may be grouped by the transmission line 114 or may be connected to the signal pad 116*a* in an array form.

In some embodiments, the radiation patterns 112 and the transmission line 114 may be formed together by the same patterning process for a metal film or an alloy film. In some embodiments, the pad electrode 116 may be patterned together with the radiation patterns 112 and the transmission line 114 to be positioned at the same level. The pad electrode 116 may be formed on an upper layer or an upper level of the radiation patterns 112 and the transmission line 114 to be connected to the transmission line 114 via a contact.

In some embodiments, the ground pad 116*b* may be electrically connected to, e.g., the ground wiring 210*b* of the upper wiring 210 of the flexible circuit board illustrated in FIG. 3, and may be electrically connected to the second electrode layer 90 of the antenna device via the ground contact 235 and the lower wiring 220.

The signal pad 116*a* may be electrically connected to the signal wiring 210*a* of the upper wiring 210 of the flexible circuit board.

Figure 6:
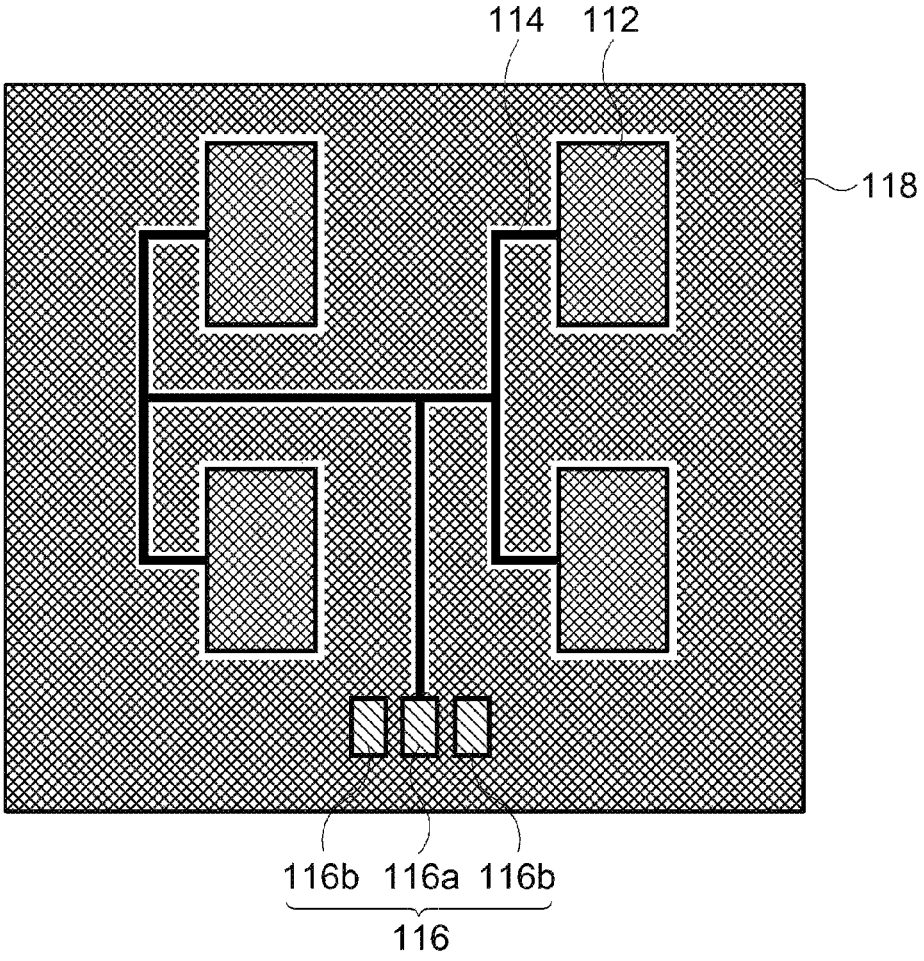
FIG. 6 is a top planar view illustrating a first electrode layer of an antenna device in accordance with some exemplary embodiments.

FIG. 6 is a top planar view illustrating a first electrode layer of an antenna device in accordance with some exemplary embodiments.

Referring to FIG. 6, the radiation pattern 112 may include a mesh structure. In some embodiments, the first electrode layer 110 may further include a dummy mesh layer 118 formed around the radiation pattern 112 and the transmission line 114.

The radiation pattern 112 may be formed of the mesh structure, so that the transmittance of the antenna device may be improved, and an arrangement of electrodes around the radiation pattern 112 may become uniform by the dummy mesh layer 118 to prevent the mesh structure and electrode lines included therein from being recognized by a user of the display device.

For example, a mesh metal layer may be formed on the dielectric layer 100, and the mesh metal layer may be cut along a predetermined area so that the dummy mesh layer 118 may be electrically and physically separated from the radiation pattern 112 and the transmission line 114.

Figure 7:
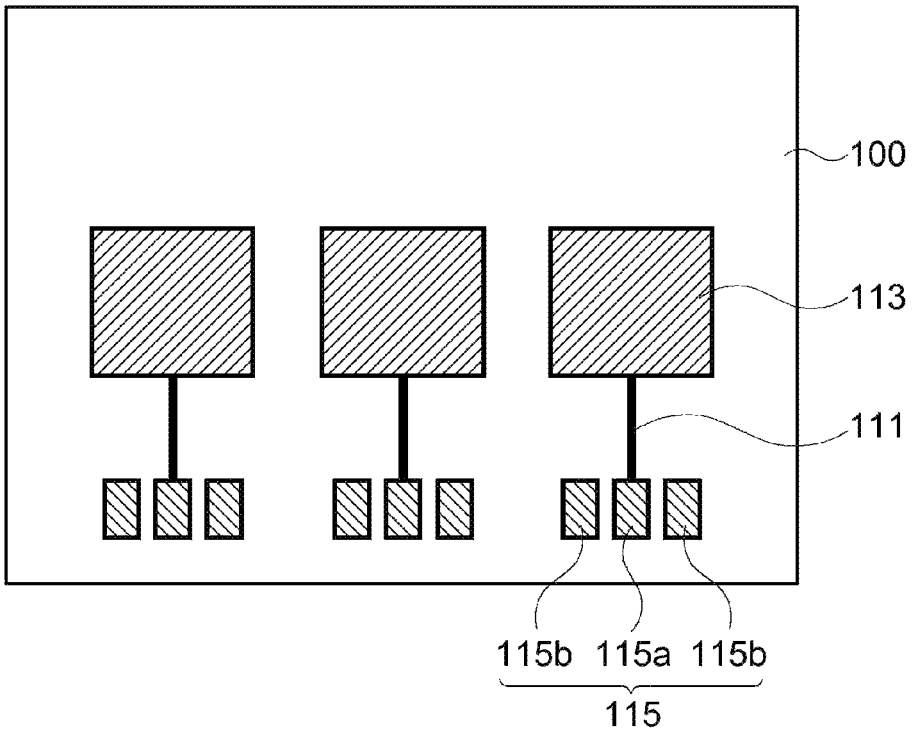
FIG. 7 is a top planar view illustrating a first electrode layer of an antenna device in accordance with some exemplary embodiments.

FIG. 7 is a top planar view illustrating a first electrode layer of an antenna device in accordance with some exemplary embodiments.

Referring to FIG. 7, each radiation pattern 113 may be electrically connected to one signal pad 115*a* through a transmission line 111. Accordingly, independent signal transmission/reception or radiation driving may be performed by each of the radiation patterns 113.

Ground pads 115*b* may be disposed at both sides of each signal pads 115*a*, and the ground pads 115*b* may be electrically connected to the second electrode layer 90 included in the antenna device by a flexible circuit board.

As described with reference to FIG. 6, the radiation patterns 113 may include a mesh structure, and a dummy mesh layer may be disposed around the radiation patterns 113 and the transmission line 111.

Figure 8:
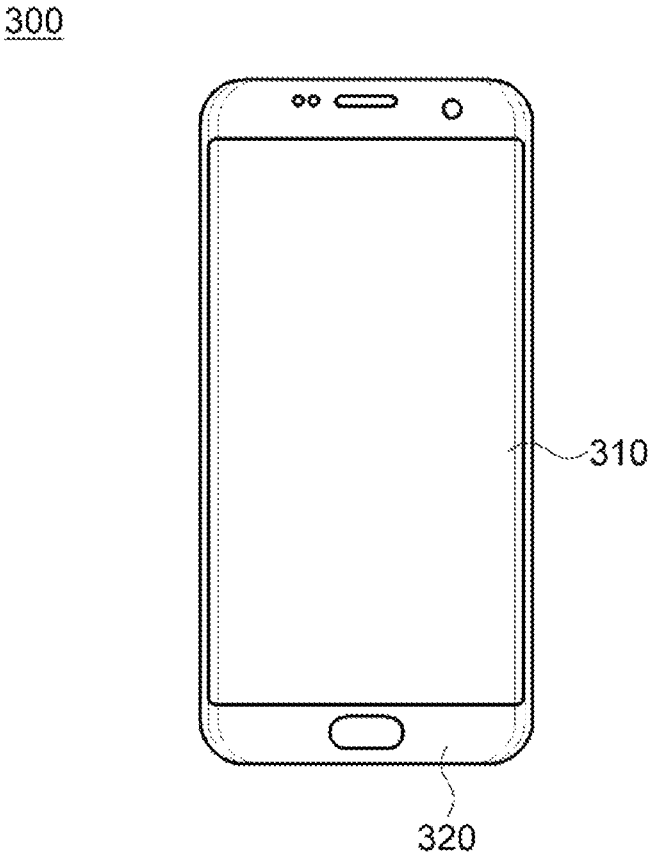
FIG. 8 is a schematic top planar view illustrating a display device in accordance with exemplary embodiments.

FIG. 8 is a schematic top planar view illustrating a display device in accordance with exemplary embodiments. For example, FIG. 8 illustrates an outer shape including a window of a display device.

Referring to FIG. 8, a display device 300 may include a display area 310 and a peripheral area 320. The peripheral area 320 may be disposed on, e.g., both lateral portions and/or both end portions of the display area 310.

In some embodiments, the above-described antenna device may be inserted in the peripheral area 320 of the display device 300 as a patch or a film shape. In some embodiments, the pad electrodes 115 and 116 of the antenna device described with reference to FIGS. 5 to 7 may be disposed to correspond to the peripheral area 320 of the display device 300.

The peripheral area 320 may correspond to, e.g., a light-shielding portion or a bezel portion of an image display device. In exemplary embodiments, the flexible circuit board 150 connecting the first and second electrode layers 110 and 90 of the antenna device may be disposed in the peripheral area 320 to prevent an image degradation at the display area 310 of the display device 300.

Additionally, the driving IC chip 160 may be also disposed on the flexible circuit board in the peripheral area 320. The pad electrodes 115 and 116 of the antenna device may be disposed to be adjacent to the flexible circuit board 150 and the driving IC chip 160 in the peripheral area 320, so that signal loss may be suppressed by shortening the signal transmission/reception path.

The radiation patterns 112 and 113 illustrated in FIGS. 5 to 7 may at least partially disposed in the display area 310. For example, as illustrated in FIG. 6, the radiation patterns 112 and 113 may be prevented from being visually recognized to the user by utilizing the mesh structure.

What is claimed is:

1. An antenna device, comprising:

a dielectric layer;

a first electrode layer disposed on a top surface of the dielectric layer, the first electrode layer comprising a radiating patch pattern;

a second electrode layer disposed on a bottom surface of the dielectric layer;

a flexible circuit board;

a first conductive intermediate layer connecting the flexible circuit board and the first electrode layer with each other; and a second conductive intermediate layer connecting the flexible circuit board and the second electrode layer with each other, wherein the flexible circuit board connecting the first electrode layer and the second electrode layer with each other via the first conductive intermediate layer and the second conductive intermediate layer along a lateral portion of the dielectric layer; and the flexible circuit board comprises:

a core layer;

an upper wiring disposed on a top surface of the core layer, the upper wiring including a signal wiring and an upper ground wiring;

a lower wiring disposed on a bottom surface of the core layer; and a ground contact penetrating through the core layer to electrically connect the upper ground wiring and the lower wiring.

2. The antenna device according to claim 1, wherein the first electrode layer comprises a ground pad, and the flexible circuit board and the ground pad are connected with each other.

3. The antenna device according to claim 2, wherein the second electrode layer comprises a ground layer.

4. The antenna device according to claim 1, wherein the ground pad of the first electrode layer is electrically connected to the second electrode layer through the upper ground wiring, the ground contact and the lower wiring of the flexible circuit board.

5. The antenna device according to claim 4, wherein the lower wiring of the flexible circuit board serves as a lower ground wiring.

6. The antenna device according to claim 1, wherein the first electrode layer further comprises a signal pad, and the signal pad is electrically connected to the signal wiring of the upper wiring in the flexible circuit board.

7. The antenna device according to claim 6, wherein the ground pad comprises a pair of ground pads, and the signal pad is interposed between the pair of the ground pads.

8. The antenna device according to claim 1, wherein the flexible circuit board comprises a first flexible circuit board electrically connected to the first electrode layer, and a second flexible circuit board electrically connected to the second electrode layer.

9. The antenna device according to claim 8, wherein the flexible circuit board further comprises a conductive connection structure electrically connecting the first flexible circuit board and the second flexible circuit board with each other.

10. The antenna device according to claim 1, wherein first electrode layer comprises a mesh structure.

11. The antenna device according to claim 10, further comprising a dummy mesh layer arranged around the radiating patch pattern.

12. A display device comprising the antenna device according to claim 1.

13. The display device according to claim 12, wherein the display device comprises a display area and a peripheral area;

at least a portion of the radiating patch pattern of the first electrode layer is disposed in the display area; and the flexible circuit board connects the first electrode layer and the second electrode layer to each other through the peripheral area.

* * * * *